US006401379B1

(12) United States Patent
Moon

(10) Patent No.: US 6,401,379 B1
(45) Date of Patent: Jun. 11, 2002

(54) HANDGUN HAVING A POLYMER FRAME

(76) Inventor: Kook-Jin Moon, 630 Rte. 303, Blauvelt, NY (US) 10913

( * ) Notice: Subject to any disclaimer, the term of this patent is extended or adjusted under 35 U.S.C. 154(b) by 0 days.

(21) Appl. No.: 09/724,042

(22) Filed: Nov. 28, 2000

(51) Int. Cl.[7] ..... F41C 23/18; F41C 23/00
(52) U.S. Cl. ..... 42/71.02; 42/71.01
(58) Field of Search ..... 42/71.01, 71.02, 42/14, 16

(56) References Cited

U.S. PATENT DOCUMENTS 3,696,706 A * 10/1972 Seidel et al. ..... 89/196
5,293,708 A * 3/1994 Strayer et al. ..... 42/75.03
5,669,169 A * 9/1997 Schmitter et al. ..... 42/75.01
5,717,156 A * 2/1998 Lenkarski ..... 89/196
5,741,996 A * 4/1998 Ruger et al. ..... 89/196
6,260,301 B1 * 7/2001 Aigner et al. ..... 42/71.02

OTHER PUBLICATIONS

Arnold, David W., Handguns Magazine (Oct. 2000), p. 50–54.*

* cited by examiner

*Primary Examiner*—Michael J. Carone
*Assistant Examiner*—Gabriel S Sukman
(74) *Attorney, Agent, or Firm*—Alix, Yale & Ristas, LLP

(57) ABSTRACT

A handgun frame assembly includes a frame member composed of polymer material. A metallic, one-piece, front structural member has a transverse connector encased in the front end portion of the floor of the frame member and right and left rail segments extending laterally inward from the interior surfaces of right and left side walls of the frame member, respectively. A metallic, one-piece, rear structural member has a transverse connector encased in the rear end portion of the floor of the frame member and right and left rail segments extending laterally outward from the exterior surfaces of the right and left side walls, respectively. A slide is supported on the rail segments of the front and rear structural members for reciprocal sliding movement between battery and retired positions.

24 Claims, 6 Drawing Sheets

HANDGUN HAVING A POLYMER FRAME

BACKGROUND OF THE INVENTION

The present invention relates to handguns. In particular, the present invention relates to such pistols having a polymer frame and metal slide.

Semiautomatic handguns have been manufactured and used for decades. Improvements in semiautomatic handguns have increased their sophistication and effectiveness. Generally, a handgun must be able to hit the target it is aimed at, to fire rounds repeatedly without jamming, and to fire only when the user intends to fire the handgun. Beyond these three basic concerns, a handgun should also be durable, have good balance, be easy to operate and service, be simple and inexpensive to manufacture, and have consistent, reasonable trigger-pull characteristics.

The components of a semiautomatic handgun may be grouped into several subassemblies. The frame generally includes a trigger guard and a hollow handle which receives a clip containing multiple rounds of ammunition. The firing system includes a trigger, a trigger bar, a sear, a striker, and a striker spring. The slide subassembly is comprised of the slide, the breech block, and the barrel. A semiautomatic handgun captures and utilizes part of the energy released from the firing of one round to load the next round into the firing chamber. Usually, the energy taken up by the recoil of a slide is used to push the next of a series of rounds into the breech block for firing.

In recent years there has been a trend in the handgun industry to utilize polymers in the manufacture of semiautomatic pistols, particularly in fabricating unitary frames by injection molding techniques. Generally, such frames are adapted to receive a metal slide removably fitted onto the frame for slidable reciprocal movement therealong. The slide is usually secured for such movement by longitudinally spaced pairs of metal rails partially embedded in the polymer of the frame. The rails provide durable metal-to-metal contact, as with tongue and groove fittings for slidable inter-engagement between the frame and slide which are characterized by superior wear and reliable operation.

It is inherently impossible for a frame composed of polymeric and metallic materials to be formed as an integral unit. Consequently, different manufacturing techniques have been devised in order to combine two or more materials into a single frame. Conventional polymer frame handguns have generally either incorporated the metal rails into the polymer during the molding process of the polymer or utilized metal rails having portions mounted within receptacles formed in the polymer during the molding process. Each of these conventional methods has certain disadvantages.

Frames manufactured by the conventional process utilize a plurality of metal rail components which must each, individually, be partially encased in the polymer material of the frame during the molding process or partially inserted into receptacles formed in the frame during the molding process. As a result, these processes are labor intensive and expensive. Consequently, there is a need for a new handgun frame and method of assembling the frame that enables the combination and cooperation of polymeric and metallic materials into its construction.

The mechanical strength characteristics of the materials from which polymer handgun frames are generally manufactured are inferior to those of the materials of metallic handgun frames. To compensate, conventional polymer handgun frames are manufactured such that the portions of the frame which are subject to the greatest amount of stress during firing of the handgun (or in some cases the entire polymer handgun frame) have a greater thickness than comparable portions of metallic handgun frames. Such differences generally result in a less aesthetically pleasing look for the handgun. The differences may also make the handgun less comfortable to grip.

SUMMARY OF THE INVENTION

It is an object of the invention to provide a handgun frame assembly including polymer materials which is easier and less expensive to manufacture.

It is another object of the invention to provide a handgun frame assembly including polymer materials having a profile similar to all-metal handgun frames.

These and related objects are achieved in accordance with the invention by providing a frame assembly for a handgun having a frame member composed of polymer material. A metallic, one-piece, front structural member has a transverse connector encased in the front end portion of the floor of the frame member. Right and left rail segments integrally connected by the transverse connector extend laterally inward from the interior surfaces of right and left side walls of the frame member, respectively. A metallic, one-piece, rear structural member has a transverse connector encased in the rear end portion of the floor of the frame member. Right and left rail segments integrally connected by the transverse connector extend laterally outward from the exterior surfaces of the right and left side walls, respectively. The right and left rail segments of the front structural member are slidingly received in a front pair of grooves in the slide and the right and left rail segments of the rear structural member are slidingly received in a rear pair of grooves in the slide.

Generally, the front and rear structural members each also have right and left side segments connecting the transverse connector to the right and left rail segments, respectively. The right and left side segments of the front structural member are at least partially encased in the right and left side walls, respectively.

The transverse connector of the front structural member includes front, rear, and middle transverse segments forming first and second openings therebetween. The front and rear transverse segments each define an aperture extending therethrough. Polymer material of the frame member extends through the first and second openings of the transverse connector and through the apertures of the front and rear transverse segments to lock the front structural element in place.

The transverse connector of the rear structural member is a single transverse segment and has an aperture extending therethrough. An indexing element of the mold used to form the frame member is received in the aperture to position and hold the rear structural member in place during the molding operation. In addition, polymer material of the frame member flows into the portion of the aperture which is not occupied by the indexing element to lock the rear structural element in place.

Right and left polymer segments in the rear end portions of the right and left sidewalls of the frame member extend longitudinally from the rear ends of the right and left rail segments of the rear structural member, respectively. The right and left polymer segments of the frame member and the right and left rail segments of the rear structural member form right and left secondary rails, respectively.

DETAILED DESCRIPTION OF PREFERRED EMBODIMENT

Figure 1:
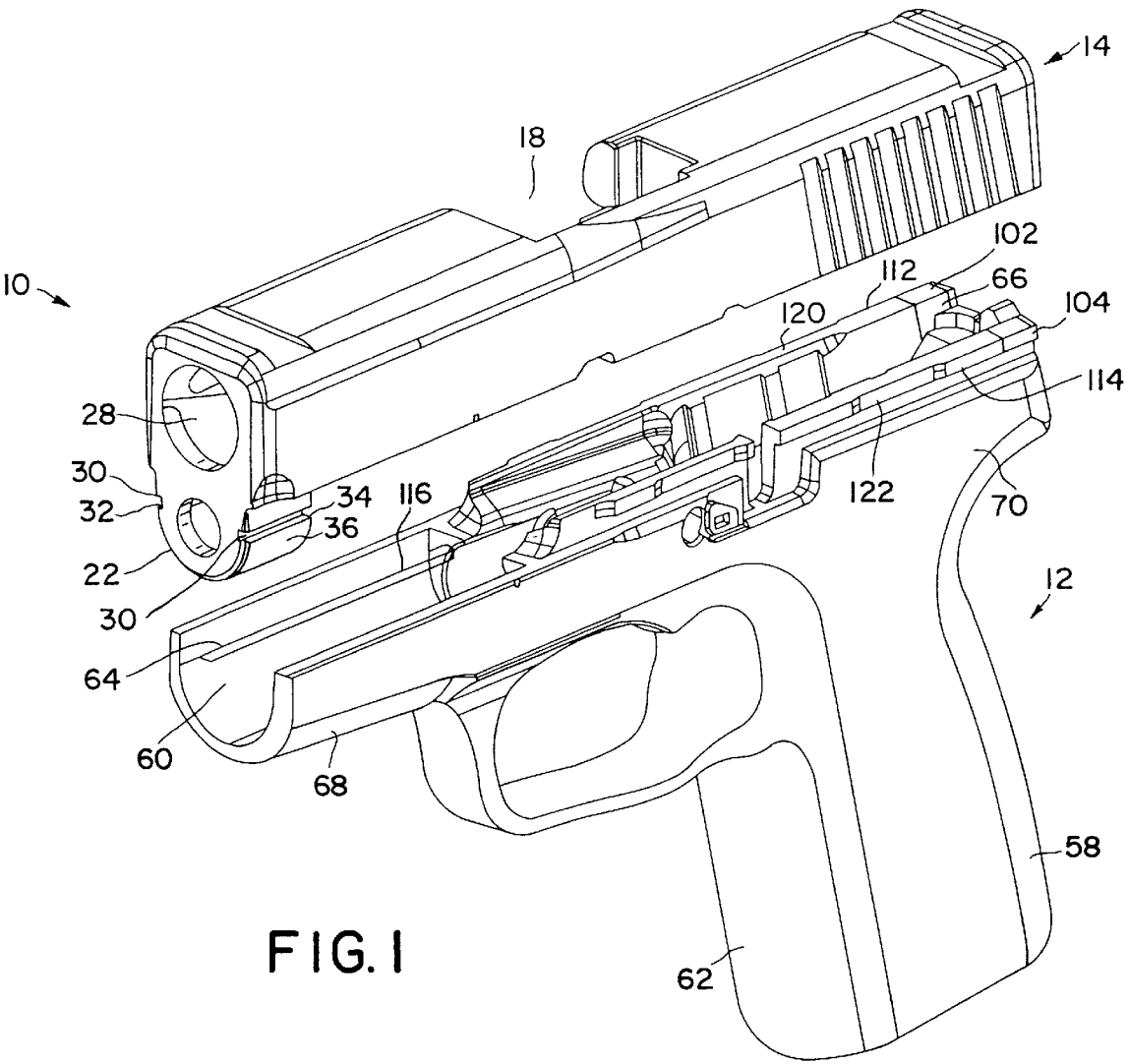
FIG. 1 is an exploded perspective view of a semi-automatic pistol embodying the present invention.

Referring now in greater detail to the drawings, FIG. 1 shows an exploded view of a portion of a semi-automatic handgun 10 having a frame assembly 12 and slide 14 embodying the present invention. In FIG. 1, for clarity of illustration, only those parts of the handgun 10 which relate to the construction and operation of the frame assembly 12 and slide 14 are shown. The other components of a semi-automatic handgun 10, such as the barrel, breech block, trigger, trigger bar, sear, striker, and various springs are well known in the art and are therefore do not require detailed description.

Figure 2:
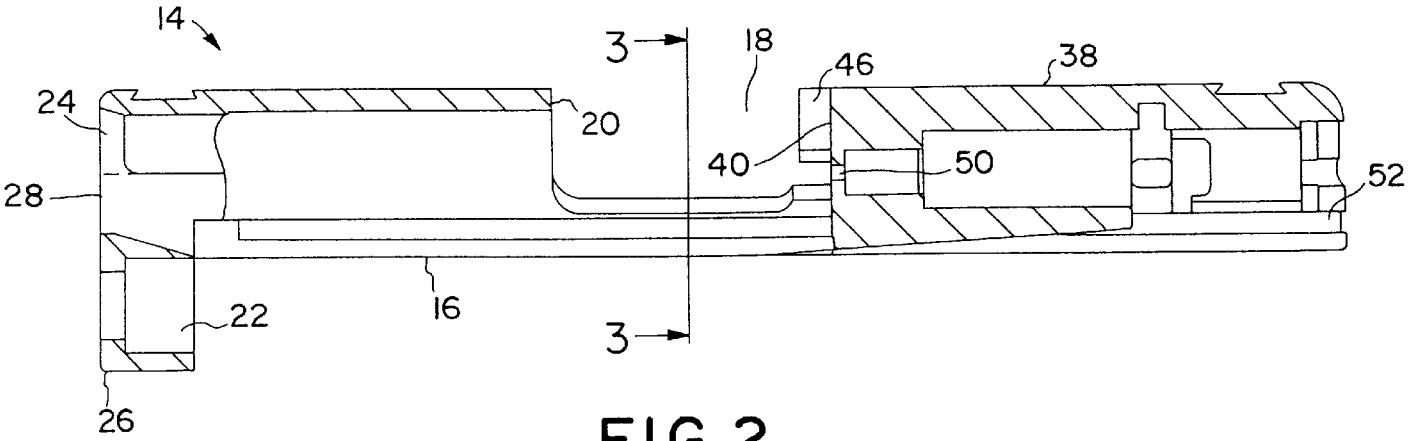
FIG. 2 is an enlarged cross sectional view of the slide of FIG. 1.
Figure 3:
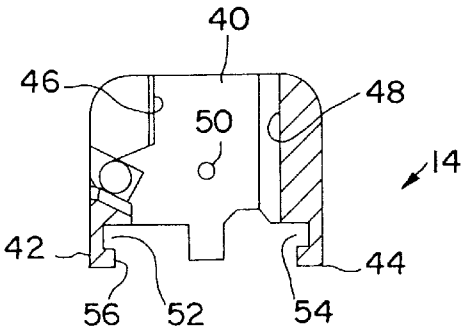
FIG. 3 is a cross sectional view taken along line 3—3 of FIG. 2.

With further reference to FIGS. 2 and 3, a hollow, downwardly open middle segment 16 of the slide 14 receives the barrel therein and has an upwardly and laterally outwardly open ejection port 18. A rearwardly facing edge of the ejection port 18, indicated at 20, cooperates with a forwardly facing surface on the barrel (not shown) to lock the slide 14 battery position.

A front end segment 22 of the slide 14 includes upper and lower portions 24, 26. The upper portion 24 has an opening 28 for receiving the muzzle of the barrel. The lower portion 26 has a front pair 30 of oppositely disposed, first and second grooves 32, 34 formed in the exterior surface 36. The first and second grooves 32, 34 extend longitudinally the full length of the right and left sides of front end segment 22.

A rear end segment 38 of the slide 14 defines a breech bolt which includes a forwardly facing breech surface 40 located at the rear of the ejection port 18 and a pair of oppositely disposed longitudinally extending skirts 42, 44 extending downwardly along each side. A pair of opposing laterally spaced apart and vertically disposed cartridge guide surfaces 46, 48 extend forwardly from opposite sides of the breech face 40. An aperture 50 opens through the breech face 40 midway between the cartridge guide surfaces 46, 48 for receiving a striker or firing pin (not shown). A rear pair of oppositely disposed, longitudinally extending, third and fourth grooves 52, 54 are formed in the interior surfaces 56 of the skirts 42, 44.

The frame assembly 12 includes a frame member 58 having a unitary structure fabricated by injection molding a high strength, heat and corrosion resistant polymer, preferably RTP 299H54780. The frame member 58 has an upwardly open channel 60 extending over the length of the frame generally from one end to the other end. A handgrip portion 62 of the frame member 58 is ergonomically designed to be easily and comfortably gripped by the user. The frame member 58 is adapted to house the firing mechanism and cooperates with the slide 14 to house the barrel. The handgrip portion 62 defines a downwardly and upwardly opening chamber (not shown) adapted to removably receive a conventional box magazine (not shown).

Figure 4:
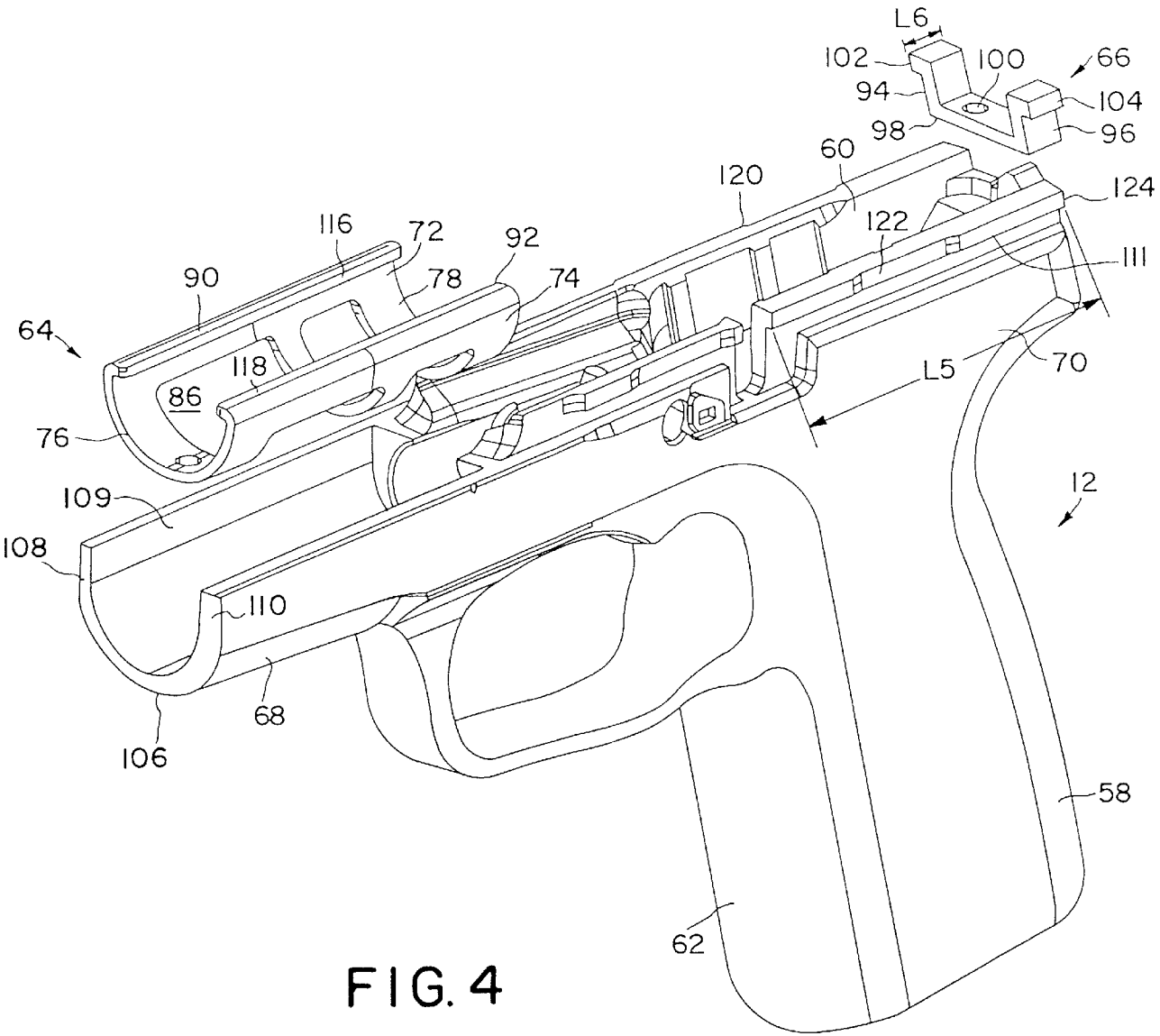
FIG. 4 is an exploded perspective view of the pistol frame assembly shown in FIG. 1.
Figure 5:
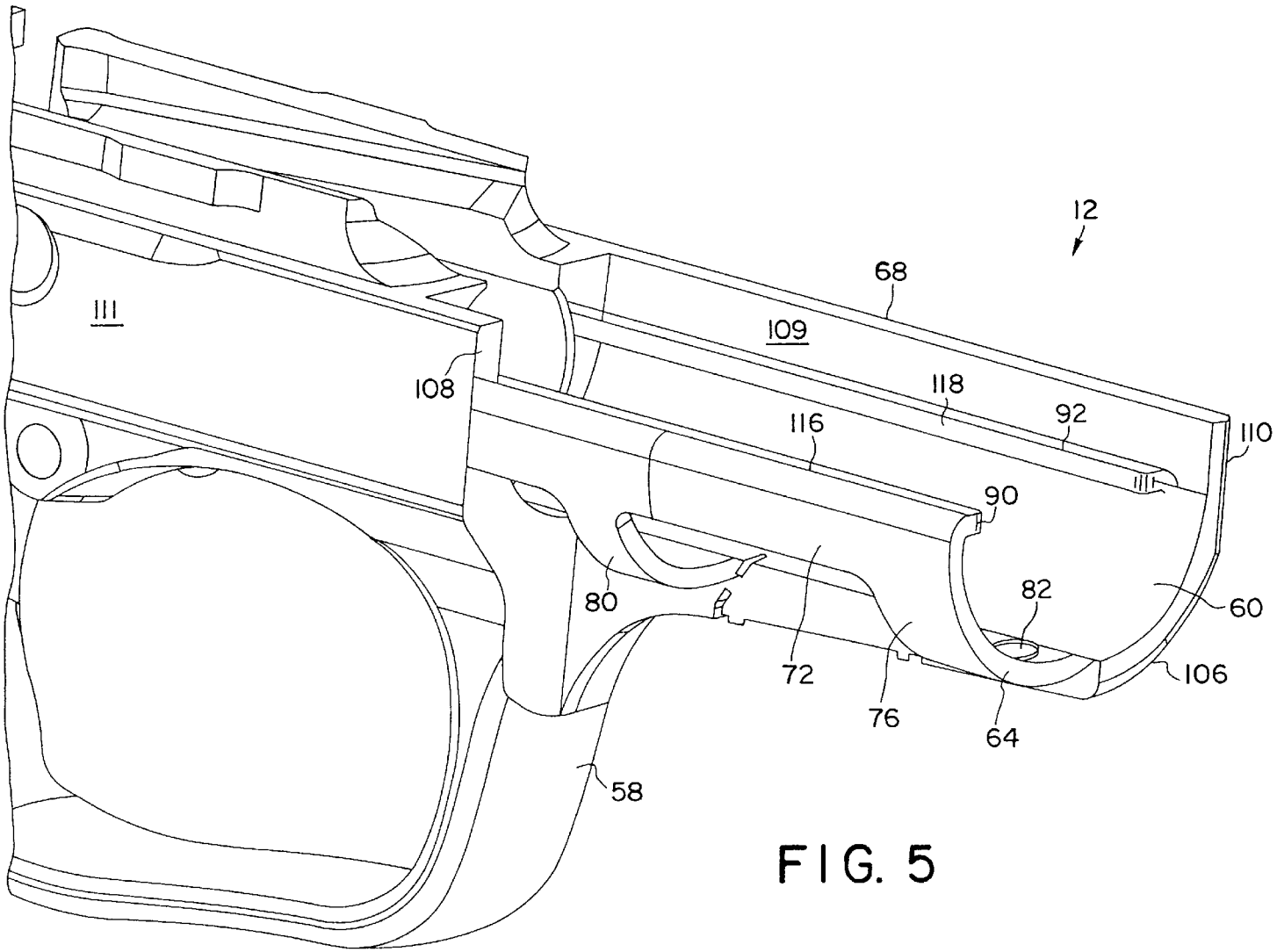
FIG. 5 is an enlarged perspective view, with a portion of the polymer frame removed, of the muzzle portion of the pistol frame assembly of FIG. 1.

With reference to FIGS. 1, 4, and 5, the frame assembly 12 also includes metallic front and rear structural members 64, 66 partially encased in front and rear portions 68, 70 of the frame member 58, respectively. At least a portion of each structural member 64, 66 is located in an area of the frame member 58 which is subject to firing-related high stress. The mechanical strength resulting from replacing a portion of the polymer material of the frame member 58 with the metal material of the structural members 64, 66 is such that the frame assembly 12 need not have a greater thickness in the high stress areas, as compared to metal handgun frames. In addition, the added strength allows the use of polymer material which is less brittle, providing a frame member 58 which has a greater expected lifetime.

Figure 6:
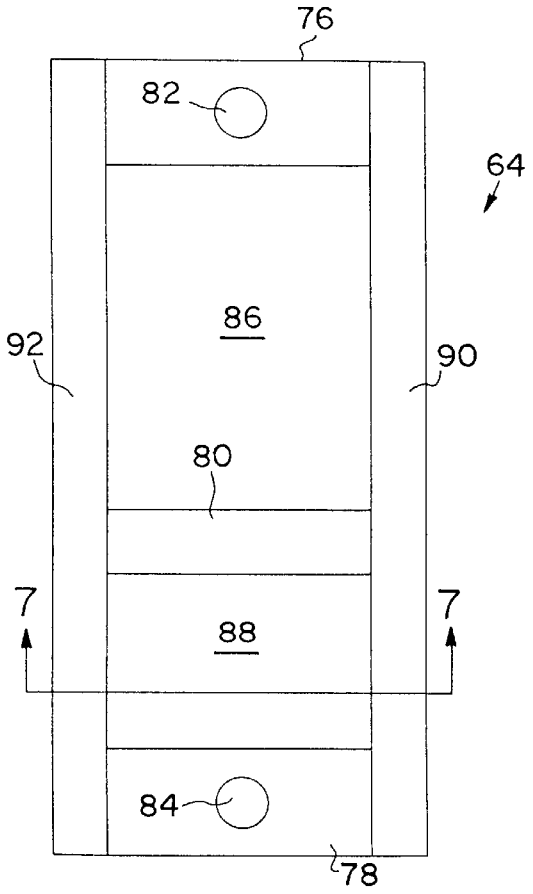
FIG. 6 is a top plan view of the front structural insert of FIG. 1.
Figure 7:
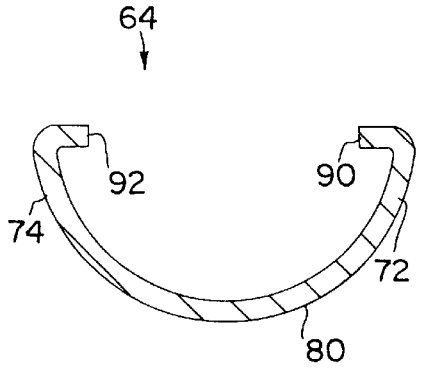
FIG. 7 is a cross sectional view through the front structural insert taken along the line 7—7 of FIG. 6.
Figure 8:
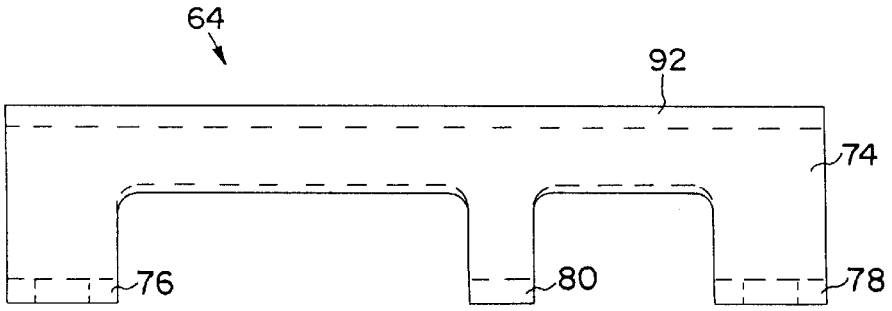
FIG. 8 is a side view of the front structural insert of FIG. 5.

With reference to FIGS. 6–8, the U-shaped front structural member 64 is a one-piece, integral structure which may easily be machined from bar stock, preferably stainless steel. Oppositely disposed right and left side segments 72, 74 are connected by front, rear, and middle transverse segments 76, 78, 80. Openings 82, 84 extending through the front and rear transverse segments 76, 78 and openings 86, 88 between the transverse segments 76, 78, 80 allow the polymer frame material to flow around and through the transverse segments during the molding process and thereby securely mount the front structural member 64 to the frame member 58. Extending laterally inward from the right and left side segments 72, 74 are right and left rail segments 90, 92, respectively. The front structural member 64 is indexed by a U-shaped holder during the molding process.

Figure 9:
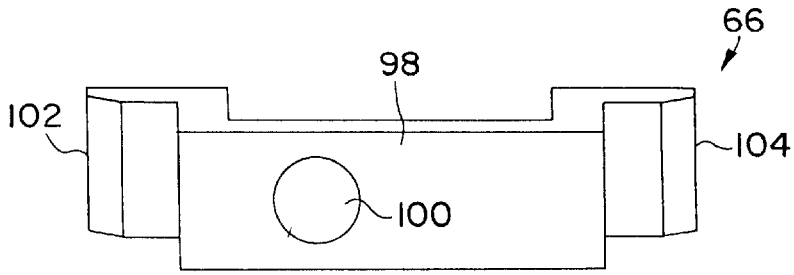
FIG. 9 is an enlarged bottom view of the rear structural insert of FIG. 1.
Figure 10:
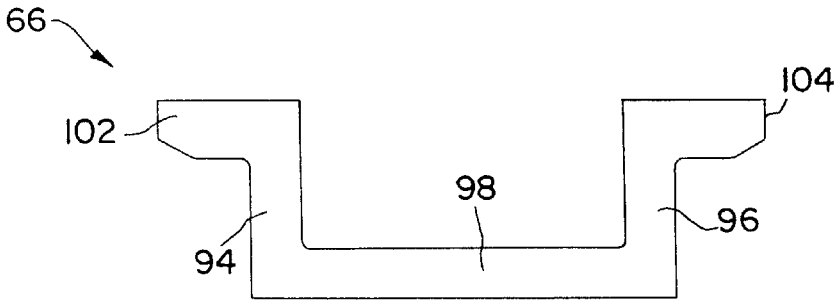
FIG. 10 is a front view of the rear structural insert of FIG. 9.
Figure 11:
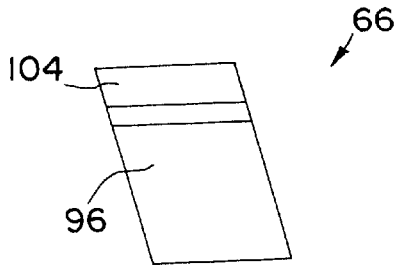
FIG. 11 is a side view of the rear structural insert of FIG. 9.

With reference to FIGS. 9–11, the rear structural member 66 is a one-piece, integral structure which may easily be machined from bar stock, or produced by metal injection molding, preferably from stainless steel. A transverse segment 98 has a single opening 100, offset to one side of transverse segment 98 and extending therethrough, which receives an indexing element of the mold to position and support the rear structural member 66 during the molding process. In addition, a portion of opening 100 may be filled with the polymer frame material during the molding process and thereby securely mount the rear structural member 66 to the frame member 58. Oppositely disposed right and left side segments 94, 96 extend upwardly and longitudinally forward from the transverse segment 98. Extending laterally outward from the right and left side segments 94, 96 are right and left rail segments 102, 104, respectively.

It should be appreciated that the use of the U-shaped holder to index the front structural member 64 and the provision of opening 100 in the transverse segment 98 for receiving an indexing element of the frame member mold facilitates proper positioning of the front and rear structural members 64, 66 within the mold, reducing the labor required for manufacturing the frame member 58 as compared to polymer frames for conventional handguns. It should also be appreciated that the use of only two metallic structural members 64, 66 further reduces the amount of labor which is required to manufacture the frame member 58, compared to that required to manufacture conventional polymer frames.

As shown in FIGS. 4 and 5, the side segments 72, 74 and the transverse segments 76, 78, 80 of the front structural member 64 are encased in the polymer material of the front portion 68 of frame member 58, with the transverse segments 76, 78, 80 extending laterally through the floor 106 of channel 60, the side segments 72, 74 extending upwardly through the side walls 108, 110 of channel 60, and the rail segments 90, 92 extend laterally inward from the interior surfaces 109 of side walls 108 and 110. The side segments 94, 96 and transverse segment 98 of the rear structural member 66 are encased in the polymer material of the rear portion 70 of frame member 58, with the transverse segment 98 extending laterally through the floor 106 of channel 60, the side segments 94, 96 extending upwardly through the exterior surfaces 111 of side walls 108, 110 of channel 60, and the rail segments 102, 104 extend laterally outward from side walls 108 and 110.

The slide 14 is supported on the frame assembly 12, for reciprocal longitudinal sliding movement between battery and retired positions, by primary rails 116, 118 and secondary rails 112, 114 of the frame assembly 12 which are disposed within the front pair 30 of grooves 32, 34 and rear pair of grooves 52, 54 of the slide 14, respectively. A recoil spring assembly (not shown), which includes a recoil spring and a recoil spring guide, acts between the forward end of the slide and a forwardly facing surface on the frame to bias the slide in a forward direction toward the battery position.

With reference to FIGS. 1 and 4, the right and left secondary rails 112, 114 include right and left polymer segments 120, 122 and the right and left rail segments 102, 104 of the rear structural member 66. The right and left polymer segments 120, 122 of the secondary rails 112, 114 are formed integrally with and extend longitudinally and laterally outward from an upper part 124 of the rear portion 70 of the frame member 58 which is disposed above the handgrip portion 62. The right and left rail segments 102, 104 abut the rear end of the right and left polymer segments 120, 122.

The primary rails 116, 118 receive the brunt of the mechanical stress imposed on the frame assembly 12 by the slide 14 as the slide 14 is driven between the battery and retired positions by the recoil spring and the blowback forces generated by the firing of a cartridge. Therefore, the primary purpose of the primary rail segments is to provide a bearing surface which will not be susceptible to wear or damage that would adversely affect the expected lifetime of the frame assembly 12. The front and rear structural members 64, 66 also provide additional mechanical strength to the frame assembly 12, as noted previously.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A handgun, comprising:

a frame assembly including a frame member composed of polymer material having front and rear end portions and right and left longitudinally extending side walls connected by a floor, each of the side walls having interior and exterior surfaces, a metallic, one-piece, front structural member having right and left rail segments integrally connected by a transverse connector, at least a portion of the transverse connector being encased in the front end portion of the floor of the frame member and at least a portion of each of the right and left rail segments extending laterally inward from the interior surfaces of the right and left side walls, respectively, a metallic, one-piece, rear structural member having right and left rail segments integrally connected by a transverse connector, at least a portion of the transverse connector being encased in the rear end portion of the floor of the frame member and at least a portion of each of the right and left rail segments extending laterally outward from the exterior surfaces of the right and left side walls, respectively; and a slide having front and rear end segments, the front end segment having an outer surface defining a front pair of oppositely disposed, longitudinally extending grooves, the rear end segment having right and left skirts having oppositely disposed interior surfaces, the interior surfaces of the right and left skirts defining a rear pair of oppositely disposed, longitudinally extending grooves;

wherein the right and left rail segments of the front structural member are slidingly received in the front pair of grooves and the right and left rail segments of the rear structural member are slidingly received in the rear pair of grooves.

2. The handgun of claim 1 wherein the front structural member further has right and left side segments connecting the transverse connector to the right and left rail segments, respectively.

3. The handgun of claim 2 wherein the right and left side segments of the front structural member are at least partially encased in the right and left side walls, respectively.

4. The handgun of claim 1 wherein the transverse connector of the front structural member includes front, rear, and middle transverse segments defining first and second openings therebetween.

5. The handgun of claim 4 wherein the polymer material of the frame member extends through the first and second openings of the transverse connector of the front structural member.

6. The handgun of claim 4 wherein the front and rear transverse segments each define an aperture extending therethrough.

7. The handgun of claim 6 wherein the polymer material of the frame member extends through the apertures of the front and rear transverse segments.

8. The handgun of claim 1 wherein the transverse connector of the rear structural member is a single transverse segment defining an aperture extending therethrough.

9. The handgun of claim 8 wherein the frame member is formed with a mold, the aperture of the single transverse segment being adapted for receiving an indexing element of the mold.

10. The handgun of claim 8 wherein the polymer material of the frame member extends into the aperture of the single transverse segment.

11. The handgun of claim 8 wherein the single transverse segment has a midpoint disposed midway between the right and left rail segments, the aperture of the single transverse segment being disposed intermediate the midpoint and one of the rail segments.

12. The handgun of claim 1 wherein the rear structural member further has right and left side segments connecting the transverse connector to the right and left rail segments, respectively.

13. The handgun of claim 12 wherein the right and left side segments of the front structural member are at least partially encased in the right and left side walls, respectively.

14. The handgun of claim 1 wherein the rear end portions of the right and left sidewalls of the frame member include longitudinally extending right and left polymer segments, the right and left polymer segments of the frame member and the right and left rail segments of the rear structural member defining right and left secondary rails, respectively.

15. The handgun of claim 14 wherein the right and left rail segments of the rear structural member each have a rear end, the right and left polymer segments of the frame member abutting the rear ends of the right and left rail segments of the rear structural member, respectively.

16. A frame assembly for a handgun comprising:

a one-piece frame member composed of polymer material having front and rear end portions and right and left longitudinally extending side walls connected by a floor, each of the side walls having interior and exterior surfaces;

a metallic, one-piece, front structural member having right and left rail segments integrally connected by a transverse connector, at least a portion of the transverse connector being encased in the front end portion of the floor of the frame member and at least a portion of each of the right and left rail segments extending laterally inward from the interior surfaces of the right and left side walls of the frame member, respectively; and a metallic, one-piece, rear structural member having right and left rail segments integrally connected by a transverse segment, at least a portion of the transverse segment being encased in the rear end portion of the floor of the frame member and at least a portion of each of the right and left rail segments extending laterally outward from the exterior surfaces of the right and left side walls of the frame member, respectively.

17. The frame assembly of claim 16 wherein the front structural member further has right and left side segments disposed intermediate the transverse connector and the right and left rail segments, respectively, the right and left side segments of the front structural member being at least partially encased in the right and left side walls, respectively.

18. The frame assembly of claim 16 wherein the transverse connector of the front structural member includes front, rear, and middle transverse segments defining first and second openings therebetween, the polymer material of the frame member extending through the first and second openings.

19. The frame assembly of claim 18 wherein the front and rear transverse segments each define an aperture extending therethrough, the polymer material of the frame member extending through the apertures of the front and rear transverse segments.

20. The frame assembly of claim 16 wherein the transverse segment of the rear structural member defines an aperture extending therethrough, the polymer material of the frame member extending into the aperture of the transverse segment of the rear structural member.

21. The frame assembly of claim 20 wherein the transverse segment of the rear structural member has a midpoint disposed midway between the right and left rail segments, the aperture of the transverse segment of the rear structural member being disposed intermediate the midpoint and one of the rail segments.

22. The frame assembly of claim 16 wherein the rear structural member further has right and left side segments connecting the transverse connector to the right and left rail segments, respectively, the right and left side segments of the front structural member being at least partially encased in the right and left side walls, respectively.

23. The frame assembly of claim 16 wherein the right and left rail segments of the rear structural member each have a rear end, the right and left sidewalls of the frame member include right and left polymer segments extending longitudinally from the rear ends of the right and left rail segments of the rear structural member, respectively, the right and left polymer segments of the frame member and the right and left rail segments of the rear structural member defining right and left secondary rails, respectively.

24. A frame assembly for a handgun comprising:

a one-piece frame member composed of polymer material having front and rear end portions and right and left longitudinally extending side walls connected by a floor, each of the side walls having interior and exterior surfaces;

a metallic, one-piece, front structural member having right and left side segments, right and left rail segments extending laterally from the right and left side segments, respectively, and front, rear, and middle transverse segments extending laterally between the right and left side segments, the front, rear, and middle transverse segments defining first and second openings therebetween, the front and rear transverse segments each defining an aperture extending therethrough; and a metallic, one-piece, rear structural member having right and left side segments, right and left rail segments extending laterally from the right and left side segments, respectively, and a single transverse segment extending laterally between the right and left side segments, the single transverse segment defining an aperture extending therethrough;

wherein each of the right and left side segments of the front and rear structural members are at least partially encased in the right and left side walls of the frame member, respectively, at least a portion of each of the front, middle, and rear transverse segments of the front structural member is encased in the front end portion of the floor of the frame member, at least a portion of each of the right and left rail segments of the front structural member extend laterally inward from the interior surfaces of the right and left side walls of the frame member, respectively, the polymer material of the frame member extends through the first and second openings and the apertures of the front and rear transverse segments of the front structural member, at least a portion of the single transverse segment of the rear structural member is encased in the rear end portion of the floor of the frame member, at least a portion of each of the right and left rail segments of the rear structural member extend laterally outward from the exterior surfaces of the right and left side walls of the frame member, respectively, and the polymer material of the frame member extends into the aperture of the single transverse segment of the rear structural member.

* * * * *